US011987273B2

(12) United States Patent
Deng et al.

(10) Patent No.: US 11,987,273 B2
(45) Date of Patent: May 21, 2024

(54) OVERHEAD MONORAIL DRIVING UNIT GROUP REALIZING MECHANICAL FAST POWER DISTRIBUTION

(71) Applicants: Anhui University of Science and Technology, Huainan (CN); TRIUMPH HEAVY INDUSTRY CO., LTD, Huainan (CN)

(72) Inventors: Haishun Deng, Huainan (CN); Tao He, Huainan (CN); Yongqin Tao, Huainan (CN); Kaisong Wang, Huainan (CN); Songsong Luo, Huainan (CN); Yang Liu, Huainan (CN); Jianhua Dong, Huainan (CN); Baqian Zhang, Huainan (CN); Licheng Zheng, Huainan (CN); Jun Chen, Huainan (CN)

(73) Assignees: Anhui University of Science and Technology, Huainan (CN); TRIUMPH HEAVY INDUSTRY CO., LTD, Huainan (CN)

( * ) Notice: Subject to any disclaimer, the term of this patent is extended or adjusted under 35 U.S.C. 154(b) by 443 days.

(21) Appl. No.: 17/369,450

(22) Filed: Jul. 7, 2021

(65) Prior Publication Data

US 2021/0331716 A1 Oct. 28, 2021

(30) Foreign Application Priority Data

May 10, 2021 (CN) ..... 202110507592.6

(51) Int. Cl.

*B61C 13/04* (2006.01)
*B61B 13/04* (2006.01)
*E01B 25/24* (2006.01)

(52) U.S. Cl.

CPC ..... *B61C 13/04* (2013.01); *B61B 13/04* (2013.01); *E01B 25/24* (2013.01)

(58) Field of Classification Search

CPC .. B61B 3/00; B61B 3/02; B61B 10/00; B61B 10/02; B61B 10/025; B61B 10/022;
(Continued)

(56) References Cited

U.S. PATENT DOCUMENTS

2019/0276056 A1* 9/2019 Ren ..... B61F 3/00

FOREIGN PATENT DOCUMENTS

CN 202088198 U 12/2011
CN 108952751 A 7/2018
(Continued)

*Primary Examiner* — Zachary L Kuhfuss
*Assistant Examiner* — Heaven R Buffington
(74) *Attorney, Agent, or Firm* — Hawaii Patent Services; Nathaniel K. Fedde; Kenton N. Fedde

(57) ABSTRACT

The present invention relates to the field of coal mine underground auxiliary transportation equipment, and particularly relates to an overhead monorail driving unit group realizing mechanical fast power distribution. The overhead monorail driving unit group realizing mechanical fast power distribution includes a rail, wherein the rail is connected with driving portions, carrying trolleys and a hoisting beam, the hoisting beam is disposed in a middle position of the driving portions and the carrying trolleys, and the driving portions, the carrying trolleys and the hoisting beam are connected through driving portion short pull rods, frame-shaped pull rods and driving portion long pull rods. Overhead monorail driving portions have four paths for transmitting a driving force to the hoisting beam, the frame-shaped pull rods directly transmit the driving force of the driving portions in positions far away from the hoisting beam to the hoisting beam, the objective is to reduce an accumulated peak value of the driving force of the driving portion in a mode of serial-parallel arrangement of the overhead monorail driving portions, the problem of horizontal direction bending failure of the rail caused by the driving portions in an operation process of an overhead
(Continued)

monorail is solved, and the reliability and adaptability of overhead monorail transportation equipment are improved.

4 Claims, 10 Drawing Sheets

(58) Field of Classification Search
CPC ..... B61B 12/02; B61B 12/028; B61B 12/10; B61B 13/04; B61C 13/04; E01B 25/10; E01B 25/24; E21F 13/00; B65G 17/20
USPC ..... 104/89, 93, 95, 162, 172.4; 213/62 R; 105/154
See application file for complete search history.

(56) References Cited

FOREIGN PATENT DOCUMENTS

CN 112850481 A * 5/2021 ..... B66C 1/14
DE 102020100731 B3 * 12/2020

* cited by examiner

OVERHEAD MONORAIL DRIVING UNIT GROUP REALIZING MECHANICAL FAST POWER DISTRIBUTION

BACKGROUND

Technical Field

The present invention relates to the field of coal mine underground auxiliary transportation equipment, and particularly relates to an overhead monorail driving unit group realizing mechanical fast power distribution.

Related Art

The "Fourteenth Five-Year Plan" in China has put forward requirements of "continuing to promote the transformation and upgrading of the industry" and "achieving coal mine production intellectualization" for the development direction of the coal mine industry, in which the auxiliary transportation of the coal mine undertakes an important business of transportation of mining equipment, coal gangues, materials and workers in a coal mine production process, and is an extremely important link in the safe and efficient production process of the coal mine. An overhead monorail, as a modern efficient coal mine auxiliary transportation mode with great potentials, will inevitably be more widely popularized and applied to gradually become an important guarantee for improving the underground transportation efficiency and promoting coal mine mining safety, efficiency and intellectualization due to its advantages of high adaptability, great driving force, etc.

Before an installation process, for an existing diesel overhead monorail, positions of driving portions need to be planned according to slope conditions of a roadway, parking adjustment is also needed in a variable-slope position, and the positions of the driving portions need to be re-arranged by an experience analogy method, so that labor and time cost is not greatly wasted. Additionally, installation errors may exist in a rail installing process, so that rails cannot be parallel to each other, and at this moment, a small-angle deflection error of the rail in a direction along the rails will enable a pull rod not to be parallel to the rail, so that the pull rod will generate a lateral force on the rail through the driving portions. The lateral force and thrust transmitted from the rail at the lower side will generate a plurality of torques on the rail, so that the rail leftwards and rightwards swings when the overhead monorail operates, or even the rail bending failure condition may occur when the overhead monorail is under a great-slope roadway and a great-load condition, a potential safety hazard is generated, and the transport capacity of a diesel overhead monorail cannot be completely achieved.

China Shenhua Energy Co., Ltd. proposes an ascending and descending device for dismounting an overhead monorail (application number: CN201120047869.3) which is used for reducing the work intensity during mounting and dismounting of the overhead monorail. However, the condition that the overhead monorail need to dispose the driving portions according to work conditions cannot be fundamentally solved, and the potential safety hazard still exists. Shandong Xinyang Energy Co., Ltd. proposes an in-situ turning method for an overhead monorail locomotive (application number: CN201810694277.7). Although this method is not provided by aiming at the problems of the present invention, a solution is indirectly provided. According to this scheme, on one hand, a branched roadway for direction change needs to be specially erected, and on the other hand, a special branched rail needs to be produced, so that the cost of the monorail transportation equipment is increased, and the method only has certain practicability on a large-size underground roadway. By aiming at the power distribution problem, Germany Scharf Company provides a method of additionally adding driving portion units at front and back sides, during going up and down the slope, the quantity of driving portions capable of achieving a driving effect is determined through an on-off state of a hydraulic loop, so that the reasonable distribution of the power during going up and down the slope is realized. By using this method, on one hand, an integral length of overhead monorail transportation equipment is increased, and the flexibility of the overhead monorail transportation in the narrow coal mine roadway transportation is improved. At the same time, the whole machine weight is also increased, and the cost is correspondingly increased.

Therefore, it is necessary to research and develop an overhead monorail driving unit group realizing mechanical fast power distribution, to be capable of reducing a torque generated on the rail in the operation process of the overhead monorail, realizing the fast power distribution according to work conditions and ensuring safe and efficient operation of the overhead monorail transportation equipment.

SUMMARY

In order to overcome the defects in the related art, the objective of the present invention is to provide an overhead monorail driving unit group realizing mechanical fast power distribution.

The objective of the present invention can be achieved by the following technical solution:

An overhead monorail driving unit group realizing mechanical fast power distribution includes a rail, wherein the rail is connected with driving portions, carrying trolleys and a hoisting beam, the hoisting beam is disposed in a middle position of the driving portions and the carrying trolleys, and the driving portions, the carrying trolleys and the hoisting beam are connected through driving portion short pull rods, frame-shaped. pull rods and driving portion long pull rods.

Further, the driving portions include a first driving portion, a second driving portion, a third driving portion, a fourth driving portion, a fifth driving portion, a sixth driving portion, a seventh driving portion and an eighth driving portion, and structures of the driving portions are the same.

The second driving portion includes a driving vehicle frame, a second driving portion vehicle frame connecting plate is disposed in a middle position of the driving vehicle frame, a second driving portion vehicle frame first side plate and a second driving portion vehicle frame second side plate are respectively disposed at two sides of the driving vehicle frame, a second driving portion left connecting seat and a second driving portion right connecting seat are respectively disposed at two ends of the driving vehicle frame, and a size of the second driving portion right connecting seat is longer than a size of the second driving portion left connecting seat.

Further, the driving portion short pull rods include a first short pull rod, a second short pull rod, a third short pull rod and a fourth short pull rod, and structures of the short pull rods are the same.

Further, the driving portion long pull rods include a first long pull rod and a second long pull rod, and structures of the long pull rods are the same.

An inner rod and an outer rod are disposed in each of the driving portion long pull rods and the driving portion short pull rods, and integral lengths of the driving portion long pull rods and the driving portion short pull rods are able to be conveniently adjusted by rotating the outer rods.

Further, the frame-shaped pull rods include a first frame-shaped pull rod, a second frame-shaped pull rod, a third frame-shaped pull rod and a fourth frame-shaped pull rod, structures of the frame-shaped pull rods are the same, a plurality of pin holes are formed in each of the frame-shaped pull rods, a length of each of the frame-shaped pull rods is adjusted according to the sizes of the driving portions, and a left portion and a right portion are connected through pins.

Universal joints are disposed at two ends of each of the driving portion long pull rods, the driving portion short pull rods and the frame-shaped pull rods, thereby achieving flexible adaptation to various rails with turnings and different slopes.

Further, the carrying trolleys include a first carrying trolley and a second carrying trolley, and structures of the carrying trolleys are the same.

A space is formed inside each of the first carrying trolley and the second carrying trolley, and the first long pull rod and the second long pull rod do not contact with each other when passing through the insides of the first carrying trolley and the second carrying trolley.

Further, four deviation correcting devices are disposed at two sides of the first carrying trolley and the second carrying trolley, carrying trolley connecting plates are disposed in middle positions of each of the carrying trolleys, carrying wheels are disposed at a bottom end of each of the carrying trolley connecting plates, and a carrying trolley first side plate and a carrying trolley second side plate are respectively disposed at two ends of the carrying trolley connecting plates.

Further, the hoisting beam includes a hoisting beam main body, hoisting beam carrying vehicles are disposed at an upper end of the hoisting beam main body, two hoisting beam fixed pull rods are disposed at upper sides of two ends of the hoisting beam main body, and are configured to transmit a driving force of the fourth driving portion; and two hoisting beam movable pull rods with adjustable extending-out lengths are disposed at lower sides of two ends of the hoisting beam main body, and are configured to transmit a driving force of the second driving portion.

Further, overhead monorail driving portions have four paths for transmitting a. driving force to the hoisting beam:

1: a first driving portion, a first short pull rod, a second driving portion, a first frame-shaped pull rod, a first carrying trolley, a second frame-shaped pull rod and the hoisting beam are sequentially in end-to-end connection, a driving force of the first driving portion is transmitted to the second driving portion through the first short pull rod, and a total driving force of the first driving portion and the second driving portion is transmitted to the hoisting beam through the first frame-shaped pull rod, the first carrying trolley and the second frame-shaped pull rod;

2: a third driving portion, a first long pull rod, a fourth driving portion, a second short pull rod and the hoisting beam are sequentially in end-to-end connection, a driving force of the third driving portion is transmitted to the fourth driving portion through the first long pull rod, and a total driving force of the third driving portion and the fourth driving portion is transmitted to the hoisting beam through the second short pull rod;

3: an eighth driving portion, a fourth short pull rod, a seventh driving portion, a fourth frame-shaped pull rod, a second carrying trolley, a third frame-shaped pull rod and the hoisting beam are sequentially in end-to-end connection, a driving force of the eighth driving portion is transmitted to the seventh driving portion through the fourth short pull rod, and a total driving force of the eighth driving portion and the seventh driving portion is transmitted to the hoisting beam through the fourth frame-shaped pull rod, the second carrying trolley and the third frame-shaped pull rod; and 4: a sixth driving portion, a second long pull rod, a fifth driving portion, a third short pull rod and the hoisting beam are sequentially in end-to-end connection, a driving force of the sixth driving portion is transmitted to the fifth driving portion through the second long pull rod, and a total driving force of the sixth driving portion and the fifth driving portion is transmitted to the hoisting beam through the third short pull rod.

BRIEF DESCRIPTION OF THE DRAWINGS

To describe the technical solutions in embodiments of the present invention or in the related art more clearly, the following briefly describes accompanying drawings required for describing the embodiments or the related art. Apparently, a person of ordinary skill in the art may still derive other drawings from these accompanying drawings without creative efforts.

Figure 1:
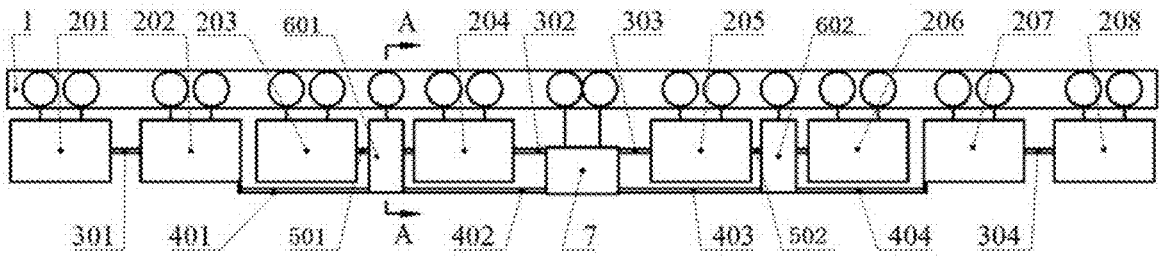
FIG. 1 is a schematic diagram of an overall structure of the present invention.

In the figures, 1 denotes a rail; 201 denotes a first driving portion; 202 denotes a second driving portion; 2021 denotes a second driving portion left connecting seat; 2022 denotes a second driving portion vehicle frame first side plate; 2023 denotes a second driving portion vehicle frame connecting plate; 2024 denotes a second driving portion vehicle frame second side plate; 2025 denotes a second driving portion right connecting seat; 203 denotes a third driving portion; 204 denotes a fourth driving portion; 205 denotes a fifth driving portion; 206 denotes a sixth driving portion; 207 denotes a seventh driving portion; 208 denotes an eighth driving portion; 301 denotes a first short pull rod; 302 denotes a second short pull rod; 303 denotes a third short pull rod; 3031 denotes an inner rod; 3032 denotes an outer rod; 304 denotes a fourth short pull rod; 401 denotes a first frame-shaped pull rod; 402 denotes a second frame-shaped pull rod; 403 denotes a third frame-shaped pull rod; 404 denotes a fourth frame-shaped pull rod; 501 denotes a first long pull rod; 502 denotes a second long pull rod; 601 denotes a first carrying trolley; 6011 denotes a deviation correcting device; 6012 denotes a carrying wheel; 6013 denotes a carrying trolley first side plate; 6014 denotes a carrying trolley connecting plate; 6015 denotes a carrying trolley second side plate; 602 denotes a second carrying trolley; 7 denotes a hoisting beam; 701 denotes a hoisting beam movable pull rod; 702 denotes a hoisting beam fixed pull rod; 703 denotes a hoisting beam carrying vehicle; and 704 denotes a hoisting beam main body.

DETAILED DESCRIPTION

The following clearly and completely describes the technical solutions in the embodiments of the present invention with reference to the accompanying drawings in the embodiments of the present invention. Apparently, the described embodiments are merely some rather than all of the embodiments of the present invention. Based on the embodiments of the invention, all other embodiments obtained by those of ordinary skill in the art without going through any creative work shall fall within the scope of protection of the invention.

An overhead monorail driving unit group realizing mechanical fast power distribution, as shown in FIG. 1 to FIG. 10, includes a rail 1, driving portions, driving portion short pull rods, frame-shaped pull rods, driving portion long pull rods, carrying trolleys and a hoisting beam 7. The rail 1 is connected with the driving portions, the carrying trolleys and the hoisting beam 7. The hoisting beam 7 is disposed in a middle position of the driving portions and the carrying trolleys. The driving portions, the carrying trolleys and the hoisting beam are connected through the driving portion short pull rods, the frame-shaped pull rods and the driving portion long pull rods.

The driving portions include a first driving portion 201, a second driving portion 202, a third driving portion 203, a fourth driving portion 204, a fifth driving portion 205, a sixth driving portion 206, a seventh driving portion 207 and an eighth driving portion 208. Structures of the driving portions are the same.

The driving portion short pull rods include a first short pull rod 301, a second short pull rod 302, a third short pull rod 303 and a fourth short pull rod 304. Structures of the short pull rods are the same.

The frame-shaped pull rods include a first frame-shaped pull rod 401, a second frame-shaped pull rod 402, a third frame-shaped pull rod 403 and a fourth frame-shaped pull rod 404. Structures of the frame-shaped pull rods are the same.

The driving portion long pull rods include a first long pull rod 501 and a second long pull rod 502. Structures of the long pull rods are the same.

The carrying trolleys include a first carrying trolley 601 and a second carrying trolley 602. Structures of the carrying trolleys are the same.

Overhead monorail driving portions have four paths for transmitting a driving force to the hoisting beam 7. The frame-shaped pull rods directly transmit the driving force of the driving portions in positions far away from the hoisting beam 7 to the hoisting beam 7. The objective is to reduce an accumulated peak value of the driving force of the driving portion in a mode of serial-parallel arrangement of the overhead monorail driving portions. The problem of horizontal direction bending failure of the rail caused by the driving portions in an operation process of an overhead monorail is solved, and the reliability and adaptability of overhead monorail transportation equipment are improved. The paths are as follows:

1: The first driving portion 201, the first short pull rod 301, the second driving portion 202, the first frame-shaped pull rod 401, the first carrying trolley 601, the second frame-shaped pull rod 402 and the hoisting beam 7 are sequentially in end-to-end connection, and are directly and fixedly connected with the hoisting beam 7 through the first frame-shaped pull rod 401, the first carrying trolley 601 and the second frame-shaped pull rod 402.

2: The third driving portion 203, the first long pull rod 501, the fourth driving portion 204, the second short pull rod 302 and the hoisting beam 7 are sequentially in end-to-end connection.

3: The eighth driving portion 208, the fourth short pull rod 304, the seventh driving portion 207, the fourth frame-shaped pull rod 404, the second carrying trolley 602, the third frame-shaped pull rod 403 and the hoisting beam 7 are sequentially in end-to-end connection, and are directly and fixedly connected with the hoisting beam 7 through the fourth frame-shaped pull rod 404, the second carrying trolley 602 and the third frame-shaped pull rod 403.

4: The sixth driving portion 206, the second long pull rod 502, the fifth driving portion 205, the third short pull rod 303 and the hoisting beam 7 are sequentially in end-to-end connection.

Figure 2:
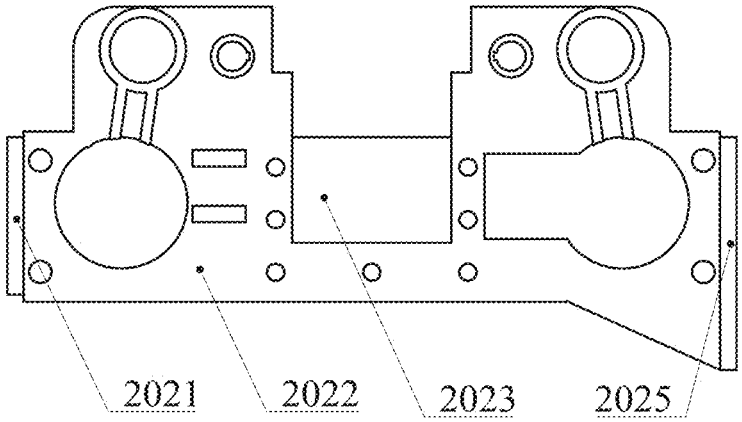
FIG. 2 is a front view of a driving portion vehicle frame of the present invention.
Figure 3:
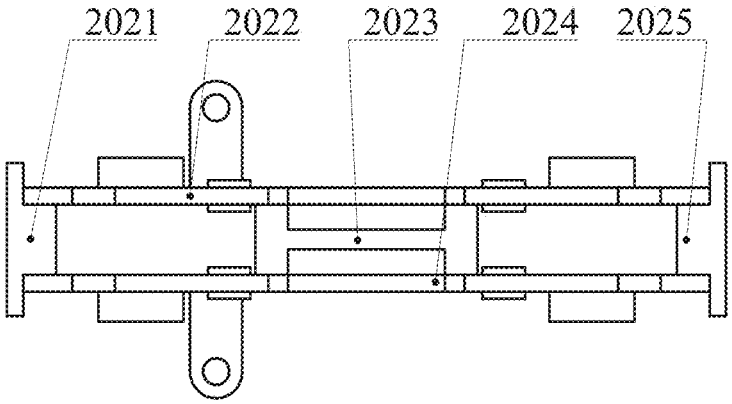
FIG. 3 is a top view of the driving portion vehicle frame of the present invention.

As shown in FIG. 2 and FIG. 3, the second driving portion 202 includes a driving vehicle frame. A second driving portion vehicle frame connecting plate 2023 is disposed in a middle position of the driving vehicle frame. A second driving portion vehicle frame first side plate 2022 and a second driving portion vehicle frame second side plate 2024 are respectively disposed at two sides of the driving vehicle frame. A second driving portion left connecting seat 2021 and a second driving portion right connecting seat 2025 are respectively disposed at two ends of the driving vehicle frame. A size of the second driving portion right connecting seat 2025 configured to carry the first frame-shaped pull rod 401 is longer than the second driving portion left connecting seat 2021, so that the driving force of the first driving portion 201 and the second driving portion 202 can go under the third driving portion 203 to be directly transmitted to the hoisting beam 7 through the first frame-shaped pull rod 401, the first carrying trolley 601 and the second frame-shaped pull rod 402.

Figure 9:
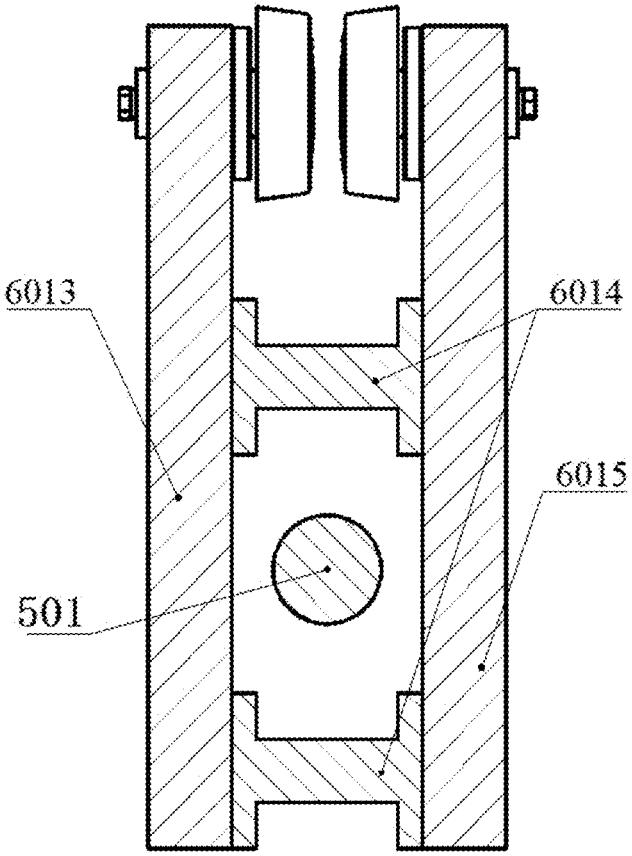
FIG. 9 is a cross-section view in a position A-A in FIG. 1 of the present invention.

As shown in FIG. 9, a space is formed inside each of the first carrying trolley 601 and the second carrying trolley 602, and the first long pull rod 501 and the second long pull rod 502 do not contact with each other when passing through the insides of the first carrying trolley 601 and the second carrying trolley 602.

Universal joints are disposed at two ends of each of the driving portion long pull rods, the driving portion short pull rods and the frame-shaped pull rods, thereby achieving flexible adaptation to various rails with turnings and different slopes. Through the frame-shaped pull rods, when the overhead monorail goes up and down a slope, the driving portions move in frameworks of the frame-shaped pull rods, and the interference between the pull rods and the driving portions during the operation of the overhead monorail is avoided.

Figure 4:
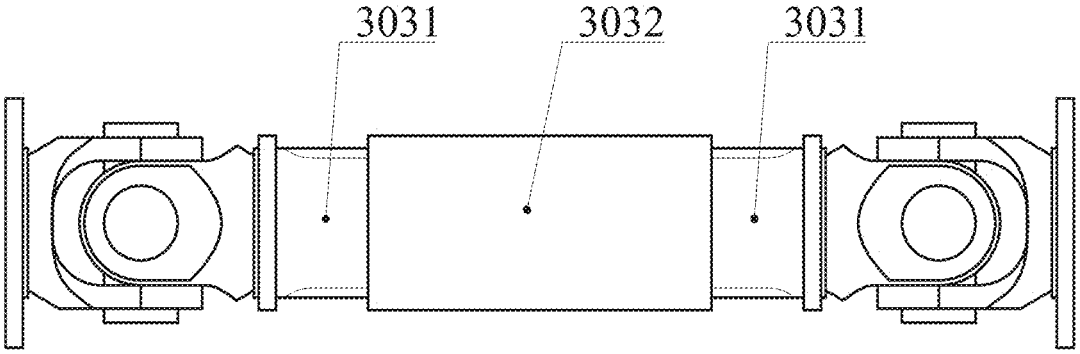
FIG. 4 is a schematic structure diagram of a driving portion short pull rod of the present invention.

As shown in FIG. 4, an inner rod 3031 and an outer rod 3032. are disposed in each of the driving portion long pull rods and the driving portion short pull rods, and integral lengths of the driving portion long pull rods and the driving portion short pull rods are able to be conveniently adjusted by rotating the outer rods 3032.

Figure 5:
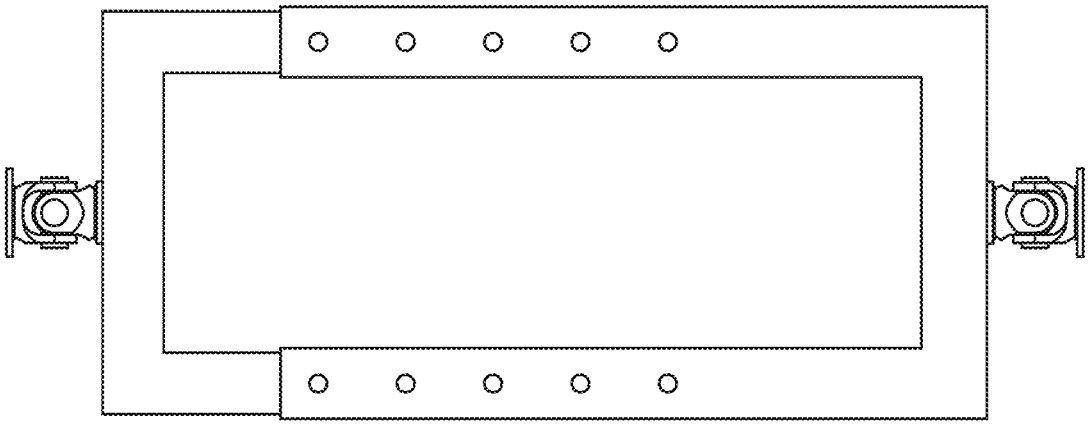
FIG. 5 is a schematic structural diagram of a frame-shaped pull rod of the present invention.

As shown in FIG. 5, a plurality of pin holes are formed in each of the frame-shaped pull rods. A length of each of the frame-shaped pull rods may be adjusted according to the sizes of the driving portions, and a left portion and a right portion are connected through pins.

Figure 6:
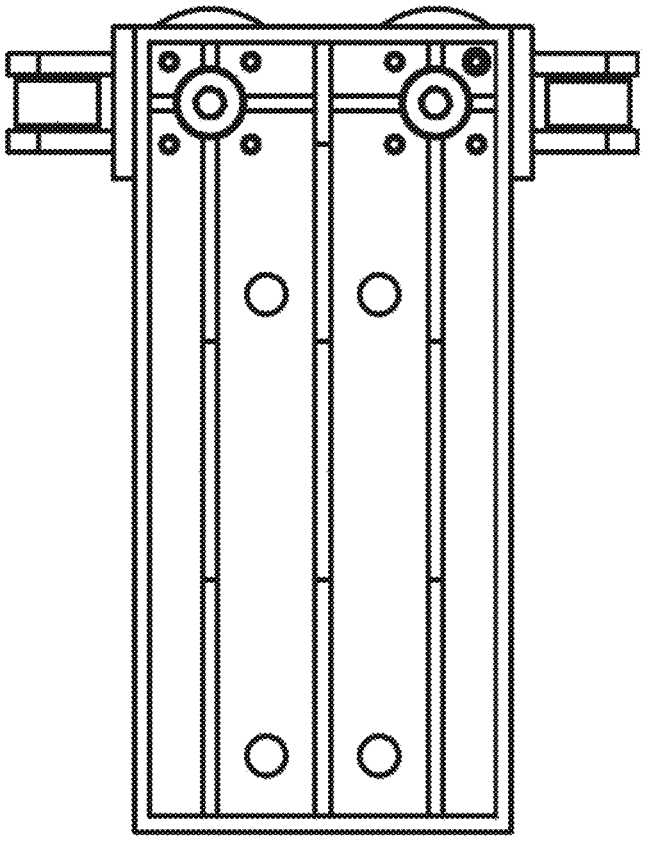
FIG. 6 is a front view of a carrying trolley of the present invention.
Figure 7:
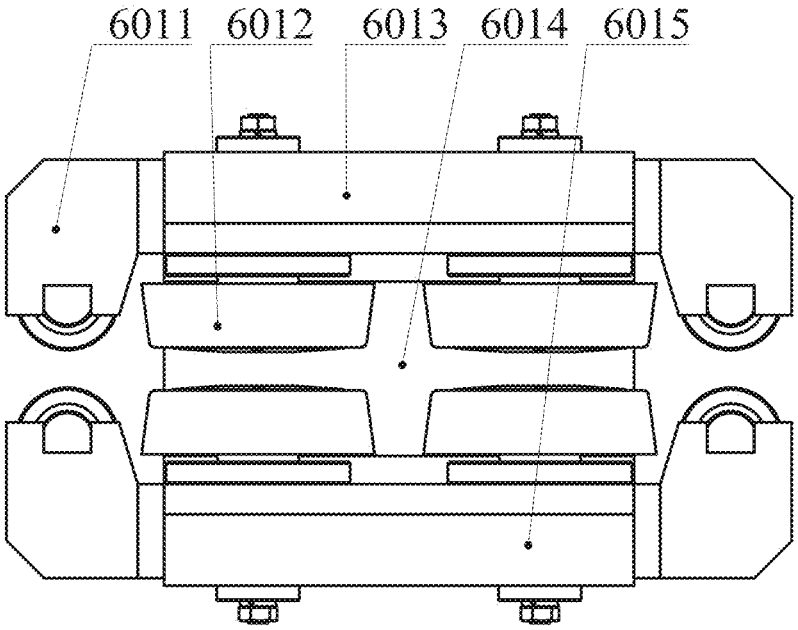
FIG. 7 is a top view of a carrying trolley of the present invention.
Figure 8:
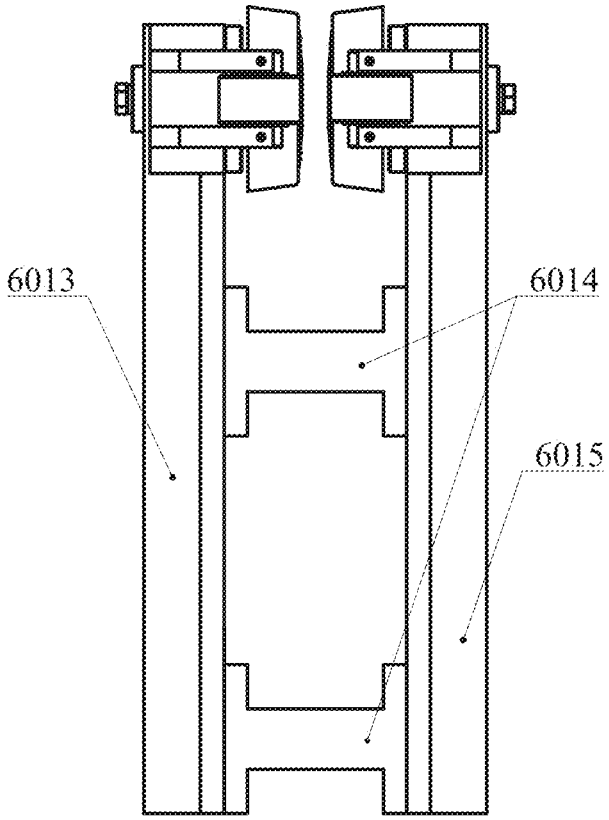
FIG. 8 is a left view of a carrying trolley of the present invention.

As shown in FIG. 6 to FIG. 8, four deviation correcting devices (6011) are disposed at two sides of the first carrying trolley 601 and the second carrying trolley 602, and are configured to position the carrying trolleys and prevent the twisting of the carrying trolleys in the horizontal direction. Carrying trolley connecting plates 6014 are disposed in middle positions of each of the carrying trolleys. Carrying wheels 6012 are disposed at a bottom end of each of the carrying trolley connecting plates 6014. A carrying trolley first side plate 6013 and a carrying trolley second side plate 6015 are respectively disposed at two ends of the carrying trolley connecting plates 6014.

Figure 10:
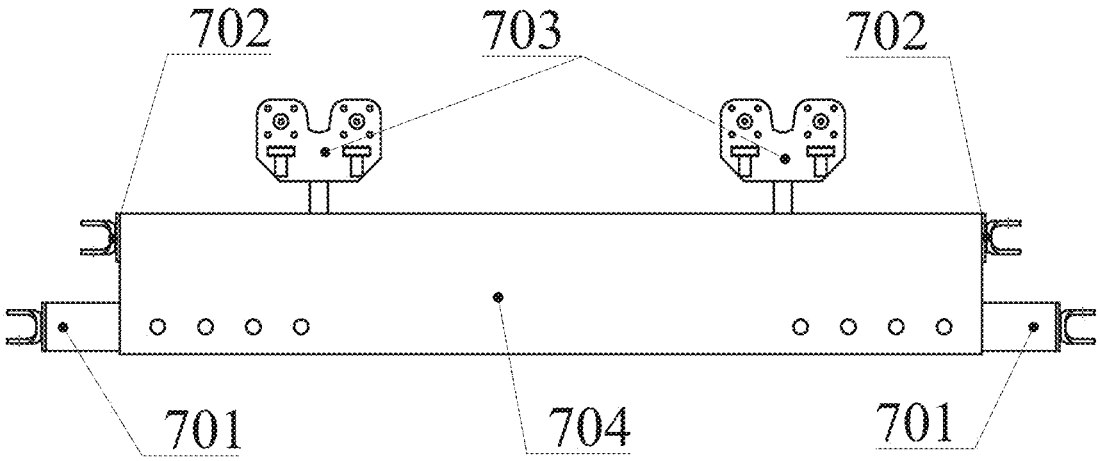
FIG. 10 is a schematic structural diagram of a hoisting beam of the present invention.

As shown in FIG. 10, the hoisting beam 7 includes a hoisting beam main body 704. Hoisting beam carrying vehicles 703 are disposed at an upper end of the hoisting beam main body 704. Two hoisting beam fixed pull rods 702 are disposed at upper sides of two ends of the hoisting beam main body 704, and are configured to transmit the driving force of the fourth driving portion 204. Two hoisting beam movable pull rods 701 with adjustable extending-out lengths are disposed at lower sides of two ends of the hoisting beam main body 704, and are configured to transmit the driving force of the second driving portion 202.

When the overhead monorail operates, the present invention directly connects the driving portions in positions far away from the hoisting beam 7 to the hoisting beam through enabling the frame-shaped pull rods to go over the driving portions in positions near the hoisting beam 7, increases original two power transmission paths at the two ends of the hoisting beam 7 into four power transmission paths, and changes an original mode of connecting all of the driving portions in series into a mode of connecting four transmission paths in parallel and connecting a plurality of driving portions in series in each of the transmission paths.

First transmission path: The first driving portion 201 is connected in series with the second driving portion 202. The driving force of the first driving portion 201 is transmitted to the second driving portion 202 through the first short pull rod 301. The total driving force of the first driving portion 201 and the second driving portion 202 is transmitted to the hoisting beam 7 through the first frame-shaped pull rod 401, the first carrying trolley 601 and the second frame-shaped pull rod 402.

Second transmission path: The third driving portion 203 is connected in series with the fourth driving portion 204. The driving force of the third driving portion 203 is transmitted to the fourth driving portion 204 through the first long pull rod 501. The total driving force of the third driving portion 203 and the fourth driving portion 204 is transmitted to the hoisting beam 7 through the second short pull rod 302.

Third transmission path: The eighth driving portion 208 is connected in series with the seventh driving portion 207. The driving force of the eighth driving portion 208 is transmitted to the seventh driving portion 207 through the fourth short pull rod 304. The total driving force of the eighth driving portion 208 and the seventh driving portion 207 is transmitted to the hoisting beam 7 through the fourth frame-shaped pull rod 404, the second carrying trolley 602 and the third frame-shaped pull rod 403.

Fourth transmission path: The sixth driving portion 206 is connected in series with the fifth driving portion 205. The driving force of the sixth driving portion 206 is transmitted to the fifth driving portion 205 through the second long pull rod 502. The total driving force of the sixth driving portion 206 and the fifth driving portion 205 is transmitted to the hoisting beam 7 through the third short pull rod 303.

Compared with existing overhead monorail equipment, the present invention has the following technical effects and advantages:

1. Due to adoption of a mechanical power distribution scheme, the following technical advantages are achieved:
   1) Easy realization: An existing overhead monorail hydraulic system does not need to be changed, so that test cost required for hydraulic system transformation is avoided.
   2) Low cost: The present invention only adds four frame-shaped pull rods and two carrying trolleys to original overhead monorail equipment, a part of driving portion carrying trolley side plates are subjected to small parts of transformation, the transformation is convenient, and the transformation cost is low.
   3) Wide applicability: The present invention performs a part of upgrading transformation on the original overhead monorail equipment, the use of overhead monorail products which have been produced is not influenced, and all the existing overhead monorails can be upgraded by this method.
   4) High reliability: On the basis of a great number of safety use data of the original overhead monorail, by adopting a mode of additionally adding accessories to the equipment, the present invention reduces the amplitude of a component force of the driving portions in positions near the hoisting beam on the rail in a direction vertical to a rail web plate, achieves an effect of avoiding rail failure on the premise of not influencing the safety of the original equipment, and improves the rail safety and reliability.

2. Due to adoption of an automatic switching scheme, the following technical advantages are achieved:
   1) Labor work intensity reduction: The present invention can better adapt to a variable-slope rail, parking for redistribution on the driving portions is not needed, the time cost and the labor cost are greatly reduced, and the potential safety hazards at an auxiliary transportation stage are reduced.
   2) High adaptability: Each of the driving portions is connected with the corresponding pull rod through the universal joint, and higher adaptability is realized on turning, and going up or down the slope of the overhead monorail.
   3) Self weight reduction: Compared with a traditional overhead monorail, the present invention achieves 100% of the utilization rate of the driving portions, avoids the redundancy of the driving portions, and reduces the self weight of the equipment.

The foregoing displays and describes basic principles, main features of the present invention and advantages of the present invention. A person skilled in the art may understand that the present invention is not limited in the foregoing embodiments. Descriptions in the embodiments and this specification only illustrate the principles of the present invention. Various modifications and improvements are made in the present invention without departing from the spirit and the scope of the present invention, and these modifications and improvements shall fall within the protection scope of the present invention.

What is claimed is:

1. An overhead monorail driving unit group realizing mechanical fast power distribution, comprising a rail, wherein the rail is connected with driving portions, carrying trolleys and a hoisting beam, the hoisting beam is disposed in a middle position of the driving portions and the carrying trolleys, and the driving portions, the carrying trolleys and the hoisting beam are connected through driving portion short pull rods, frame-shaped pull rods and driving portion long pull rods, wherein the driving portions comprise a first driving portion, a second driving portion, a third driving portion, a fourth driving portion, a fifth driving portion, a sixth driving portion, a seventh driving portion and an eighth driving portion, and structures of the driving portions are the same;

wherein the second driving portion comprises a driving vehicle frame, a second driving portion vehicle frame connecting plate is disposed in a middle position of the driving vehicle frame, a second driving portion vehicle frame first side plate and a second driving portion vehicle frame second side plate are respectively disposed at two sides of the driving vehicle frame, a second driving portion left connecting seat and a second driving portion right connecting seat are respectively disposed at two ends of the driving vehicle frame, and a size of the second driving portion right connecting seat is longer than a size of the second driving portion left connecting seat; and wherein the frame-shaped pull rods comprise a first frame-shaped pull rod, a second frame-shaped pull rod, a third frame-shaped pull rod and a fourth frame-shaped pull rod, and structures of the frame-shaped pull rods are the same.

2. The overhead monorail driving unit group realizing mechanical fast power distribution according to claim 1, wherein the hoisting beam comprises a hoisting beam main body, hoisting beam carrying vehicles are disposed at an upper end of the hoisting beam main body, two hoisting beam fixed pull rods are disposed at upper sides of two ends of the hoisting beam main body, and are configured to transmit a driving force of the fourth driving portion; and two hoisting beam adjustable pull rods with adjustable extending-out lengths are disposed at lower sides of two ends of the hoisting beam main body, and are configured to transmit a driving force of the second driving portion.

3. An overhead monorail driving unit group realizing mechanical fast power distribution, comprising a rail, wherein the rail is connected with driving portions, carrying trolleys and a hoisting beam, the hoisting beam is disposed in a middle position of the driving portions and the carrying trolleys, and the driving portions, the carrying trolleys and the hoisting beam are connected through driving portion short pull rods, frame-shaped pull rods and driving portion long pull rods, wherein the driving the portion long pull rods comprise a first long pull rod and a second long pull rod;

wherein the carrying trolleys comprise a first carrying trolley and a second carrying trolley, and structures of the carrying trolleys are the same; and wherein a space is formed inside each of the first carrying trolley and the second carrying trolley, and the first long pull rod and the second long pull rod do not come into contact with the first carrying trolley and the second carrying trolley when passing through an inside of the respective carrying trolley.

4. An overhead monorail driving unit group realizing mechanical fast power distribution, comprising a rail, wherein the rail is connected with driving portions, carrying trolleys and a hoisting beam, the hoisting beam is disposed in a middle position of the driving portions and the carrying trolleys, and the driving portions, the carrying trolleys and the hoisting beam are connected through driving portion short pull rods, frame-shaped pull rods and driving portion long pull rods, wherein overhead monorail driving portions have four paths for transmitting a driving force to the hoisting beam, the four paths being:

1: a first driving portion, a first short pull rod, a second driving portion, a first frame-shaped pull rod, a first carrying trolley, a second frame-shaped pull rod and the hoisting beam are sequentially in end-to-end connection, a driving force of the first driving portion is transmitted to the second driving portion through the first short pull rod, and a total driving force of the first driving portion and the second driving portion is transmitted to the hoisting beam through the first frame-shaped pull rod, the first carrying trolley and the second frame-shaped pull rod:

2: a third driving portion, a first long pull rod, a fourth driving portion, a second short pull rod and the hoisting beam are sequentially in end-to-end connection, a driving force of the third driving portion is transmitted to the fourth driving portion through the first long pull rod, and a total driving force of the third driving portion and the fourth driving portion is transmitted to the hoisting beam through the second short pull rod;

3: an eighth driving portion, a fourth short pull rod, a seventh driving portion, a fourth frame-shaped pull rod, a second carrying trolley, a third frame-shaped pull rod and the hoisting beam are sequentially in end-to-end connection, a driving force of the eighth driving portion is transmitted to the seventh driving portion through the fourth short pull rod, and a total driving force of the eighth driving portion and the seventh driving portion is transmitted to the hoisting beam through the fourth frame-shaped pull rod, the second carrying trolley and the third frame-shaped pull rod; and 4: a sixth driving portion, a second long pull rod, a fifth driving portion, a third short pull rod and the hoisting beam are sequentially in end-to-end connection, a driving force of the sixth driving portion is transmitted to the fifth driving portion through the second long pull rod, and a total driving force of the sixth driving portion and the fifth driving portion is transmitted to the hoisting beam through the third short pull rod.

* * * * *